United States Patent [19]

Sato et al.

[11] Patent Number: 4,918,872

[45] Date of Patent: Apr. 24, 1990

[54] SURFACE GRINDING APPARATUS

[75] Inventors: Takesi Sato; Kenichi Mitsuhashi; Yoji Tomita; Yasuoki Sasaki, all of Ibaraki, Japan

[73] Assignee: Kanebo Limited, Tokyo, Japan

[21] Appl. No.: 216,483

[22] Filed: Jul. 8, 1988

Related U.S. Application Data

[63] Continuation of Ser. No. 16,985, Feb. 19, 1987, abandoned, which is a continuation of Ser. No. 732,207, May 9, 1984, abandoned.

[30] Foreign Application Priority Data

May 14, 1984 [JP] Japan ..... 59-97223

[51] Int. Cl.[5] ..... B24D 5/10

[52] U.S. Cl. ..... 51/209 R; 51/204; 51/206.4; 51/267

[58] Field of Search ..... 51/209 R, 204, 206.4, 51/267

[56] References Cited

U.S. PATENT DOCUMENTS

| | | | |
|---|---|---|---|
| 2,089,040 | 8/1937 | Shue | 51/209 R |
| 3,026,655 | 3/1962 | Osenberg | 51/209 R |
| 4,037,367 | 7/1977 | Kuse | 51/209 R |

*Primary Examiner*—Judy J. Hartman
*Assistant Examiner*—Maurina Rachuba
*Attorney, Agent, or Firm*—Armstrong, Nikaido, Marmelstein, Kubovcik & Murray

[57] ABSTRACT

A surface grinding apparatus including a plurality of grinding wheel segments which are attached to a lapping platen directly or through an attachment plate so that the working surfaces of the segments form one plane, wherein the surface of a material to be ground is brought into sliding contact with the grinding wheel segments to grind the surface of the material. The grinding wheel segments are arranged so that a plurality of grooves are formed extending in a direction opposite to the advancing direction of the platen from the inner side of the platen toward the outer side thereof and communicate with the outer side of the platen.

4 Claims, 8 Drawing Sheets

SURFACE GRINDING APPARATUS

This is a continuation of application Ser. No. 016,985, filed Feb. 19, 1987, now abandoned, which is a continuation of application Ser. No. 732,207, filed May 9, 1984, now abandoned.

BACKGROUND OF THE INVENTION (1) Field of the Invention

The present invention relates to a surface grinding apparatus. More particularly, the present invention relates to a surface grinding apparatus for grinding uniformly and efficiently surfaces of various materials having a flat surface and differing in shape, such as plate-like and disk-like materials composed of metals, glass, synthetic resins, or the like.

(2) Description of the Related Art

Surface grinding of metal plates, glass, sheets, synthetic resin plates, and the like is often performed by a lapping machine. Such a machine is provided with a plate-like lapping platen or a lapping platen having artificial suede leather bonded thereto. A material to be ground is pressed to the lapping platen, grinding slurry containing abrasive grains is steadily supplied, and the material is slid on the lapping platen. Various lapping machines are known for performing such grinding operations, for example, a lapping machine is which a single lapping platen is rotated to effect grinding at a high efficiency and a lapping machine in which a material to be ground is gripped between upper and lower lapping platens rotated in opposite directions to simultaneously grind both surfaces of the material.

In each of these known machines, grinding is carried out with a steady supply of a slurry containing a high concentration of abrasive grains to the surface of the material to be ground. The abrasive grains contaminate the apparatus and equipment. Furthermore, the amount of abrasive grains effectively used for the grinding is very small, though a large quantity of abrasive grains is used overall. This increases the grinding cost. Moreover, the waste liquid containing the abrasive grains and grinding shavings must be treated before discharge.

As means for overcoming these defects, it has been proposed to mount a solid grinding wheel having abrasive grains incorporated therein on a lapping platen and perform grinding with a steady supply of water or water containing a small amount of a surface active agent instead of the abrasive grain-containing slurry. This method, however, is defective in that abrasive grains falling from the grinding wheel and grinding shavings intrude into fine pores on the surface of the grinding wheel, causing loading and necessitating frequent dressing operations to prevent reduction of the grinding power.

SUMMARY OF THE INVENTION

We made research with a view to solving the problems of the conventional surface grinding methods and machines. As the result, we have now completed the present invention. It is a primary object of the present invention to provide a surface grinding apparatus in which occurrence of loadinging and reduction of the grinding power with the lapse of time are controlled and in which a material to be ground can be ground uniformly and smoothly.

In accordance with the present invention, this object can be attained by a surface grinding apparatus including a plurality of grinding wheel segments attached to a lapping platen directly or through an attachment plate so that the working surfaces of the segments exist on one plane. The surface of a material to be ground is brought into sliding contact with the grinding wheel segments to grind the surface of the material. The grinding wheel segments are arranged so that a plurality of grooves are formed extending in a direction opposite to the advancing direction of the platen from the inner side of the platen toward the outer side thereof and communicating with the outer side of the platen.

DESCRIPTION OF THE PREFERRED EMBODIMENTS

The present invention will now be described in detail with reference to the accompanying drawings.

Figure 1:
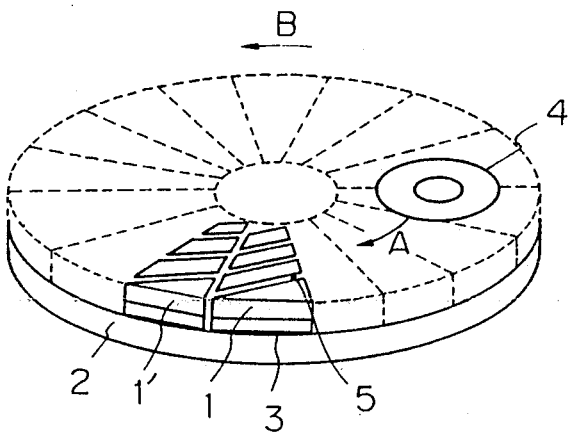
FIG. 1 is a diagram illustrating one embodiment of a surface grinding apparatus having a lapping platen grinding surface according to the present invention.
Figure 2:
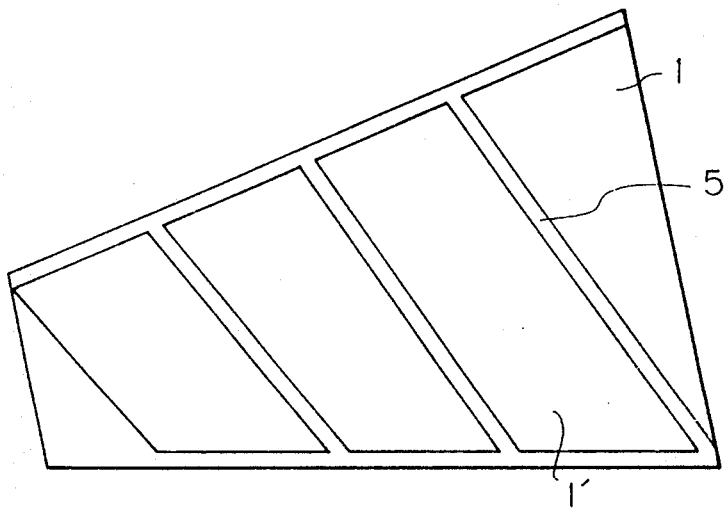
FIG. 2 is an enlarged diagram showing the attachment plate of the surface grinding apparatus shown in FIG. 1.
Figure 3:
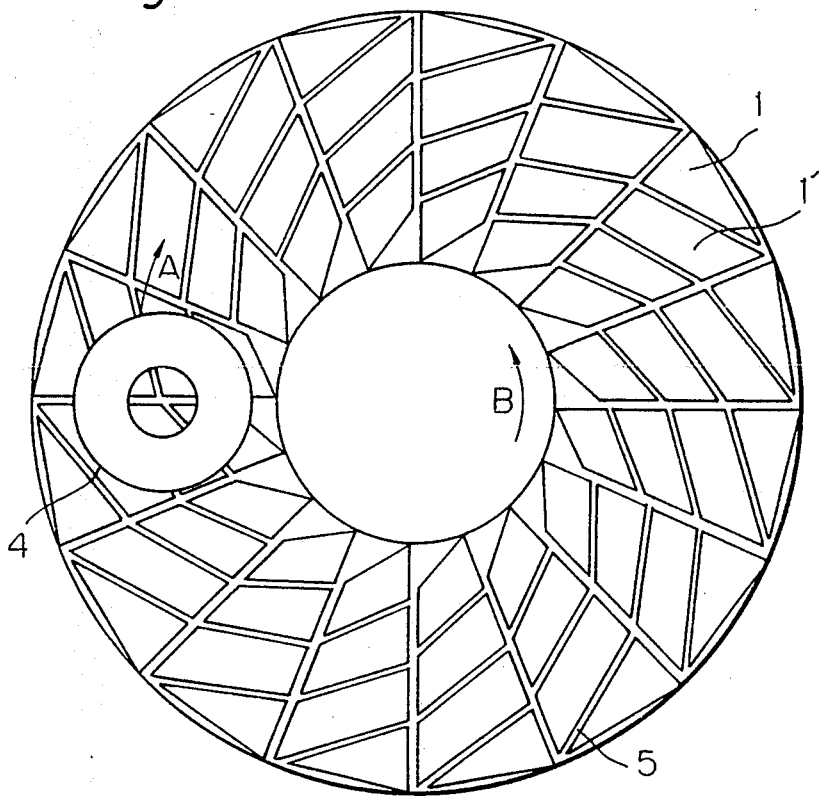
FIG. 3 is an enlarged diagram showing the grinding surface of the lapping platen of the surface grinding apparatus shown in FIG. 1.

In FIGS. 1 through 3, reference numerals 1 and 1' represent grinding wheel segments, 2 a pedestal of a lapping platen, 3 an attachment plate, 4 a material to be ground, and 5 a groove. Referring to FIG. 1, grinding wheel segments 1 are attached to the lapping platen through the attachment plate 3. The grinding wheel segments 1, however, may be attached directly to the pedestal 2 of the lapping platen. As the shape of the grinding wheel segments, there can be mentioned a rectangular shape, a rhombic shape, a trapezoidal shape, and a triangular shape, but the shape of the grinding wheel segments is not particularly critical. In the present invention, first of all, it is important that the grinding wheel segments be arranged on the lapping platen so that a plurality of grooves are formed extending in a direction opposite to the advancing direction of the platen from the inner side of the platen toward the outer side of the platen and communicating with the outer side of the platen. When the surface of a material to be ground is ground by using an ordinary lapping platen having solid grinding wheel segments attached thereto, falling abrasive grains, grinding shavings, and water are not discharged much at all from the platen and remain on the grinding surface to cause loading and reduce the grinding power. According to the present invention, as pointed out hereinbefore, side grooves having a specific shape are formed along the grinding surfaces of the grinding wheel segments, and therefore, waste such as falling abrasive grains and grinding shavings are always discharged from the platen through these grooves. As a result, loading of the grinding surface is moderated and the grinding power can be maintained for a long time.

As is apparent from FIGS. 2 and 3, showing main parts of the surface grinding apparatus of FIG. 1 in an enlarged manner, the grinding wheel segments are radially arranged at substantially equal intervals. Snail grooves are formed communicating with the outer side of the platen along the grinding surface, and radial grooves are formed communicating with the snail grooves. The radial grooves need not always be formed. The grinding operation using this surface grinding apparatus will now be described with reference to FIG. 3. A material 4 to be ground is brought into sliding contact with the grinding wheel segments 1 and 1'. These slide on the surface of the material 4 when the lapping platen is rotated in the direction of arrow B. A force acting in the direction of arrow A is therefore imposed on the material 4. Waste formed by the grinding such as falling grinding grains, grinding shavings, and water, are acted upon by the force in the direction of arrow A and are promptly, smoothly, and continuously discharged through the snail grooves 5 and 5' defined by the grinding wheel segments. An apparatus having a grinding surface in which the ratio of the area of the surfaces of the grinding wheel segments to the surface area of the grooves is relatively large as shown in FIG. 3 is suitable for grinding a material having a small size and a small surface area to be ground.

Figure 4:
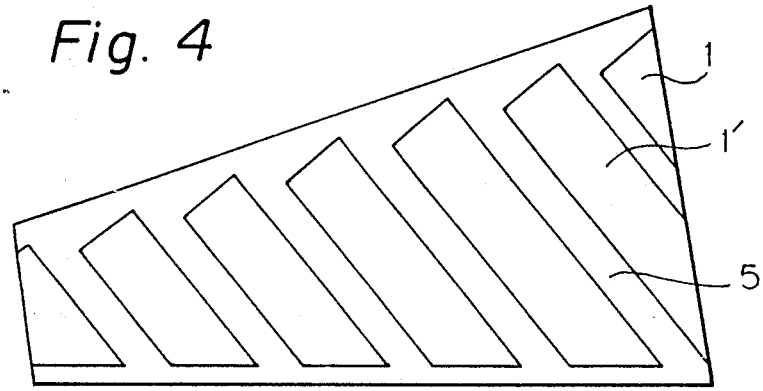
FIG. 4 is an enlarged partial view showing an example of an attachment plate provided with a lapping platen grinding surface according to the present invention.
Figure 7:
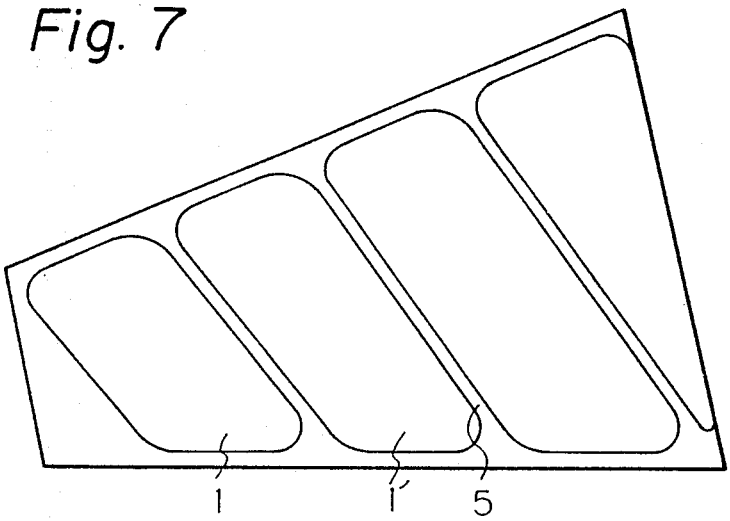
FIGS. 7 through 9 are enlarged partial views illustrating examples of the attachment plate provided with a lapping platen grinding surface according to the present invention.
Figure 8:
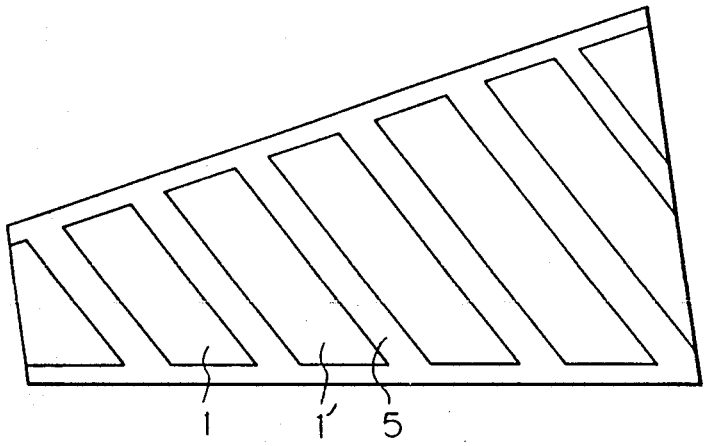
Figure 9:
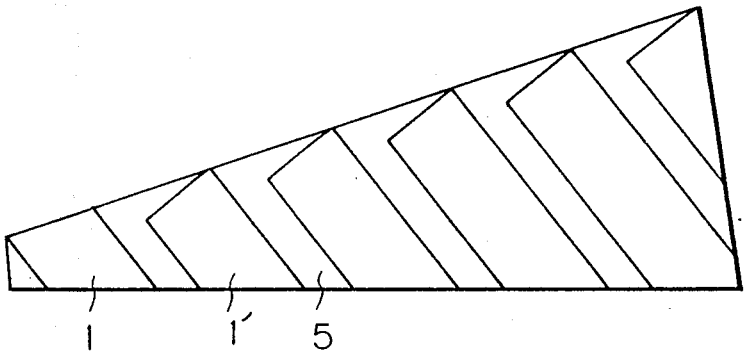

FIG. 4 is an enlarged partial view showing an example of an attachment plate having a grinding surface of a lapping platen according to the present invention. Referring to FIG. 4, a plurality of long rectangular grinding wheel segments and triangular grinding wheel segments are relatively thinly arranged in parallel at equal intervals so that they are inclined at about 60° to the central line of the trapezoidal attachment plate 3. An apparatus in which the ratio of the area of the grinding wheel segments to the surface area of the grooves is relatively small as shown in FIG. 4 is suitable for grinding a material having a relatively large size and a large surface area. In the present invention, since the grooves are formed non-concentrically as shown in FIGS. 3 and 4, when the lapping platen is rotated and a material to be ground is pressed to the surfaces of the grinding wheel segments, the entire surface of the material is brought into sliding contact with the surfaces of the grinding wheel segments and the problem of so-called loose grinding is not caused. In the present invention, it is preferred that the grooves defined by the grinding wheel segments be formed to intersect the advancing direction of the platen with an angle of 100° to 135°. If this intersection angle is too small, the friction resistance between the grinding wheel segments and the material to be ground is increased, and vibration or shaking of the apparatus is readily caused. On the other hand, if the intersection angle is too large, uniform grinding of the material becomes difficult and there is the danger that an unground portion will be left. Other examples of attachment plates having grinding surfaces of the lapping platen are shown in FIGS. 7 through 9. If discharge of grinding shavings, falling abrasive grains, and water from the lapping platen, uniform grinding, prevention of loose grinding, and other requirements are collectively taken into consideration, it is especially preferred that grinding wheel segments be arranged so that a plurality of snail grooves are formed extending in a direction opposite to the advancing direction of the platen from the inner side of the platen toward the outer side of the platen and communicating with the outer side of the platen.

As the abrasive material constituting the grinding wheel segments of the present invention, there can be mentioned a vitrified grindstone, a resinoid type grindstone, a shellac type grindstone, a rubber type grindstone and a urethane type grindstone. It is especially preferred that the grinding wheel segments be composed of a synthetic water-resistant polyvinyl formal type abrasive material. As the polyvinyl formal type synthetic water-resistant grindstone, there can be mentioned products obtained by dispersing granular fine powders or whiskers of silicon carbide, aluminum oxide, chromium oxide, cerium oxide, or the like or mixtures thereof as abrasive grains into porous bodies composed mainly of polyacetal type synthetic resins. Products obtained by incorporating in these synthetic grindstones a phenolic resin, an epoxy resin, a urethane resin, or other thermosetting resins are especially preferred from the viewpoint of the water resistance. The shape of the grinding wheel segments is not particularly critical in the present invention, as pointed out hereinbefore, but when grinding wheel segments having a corner-cut shape as shown in FIG. 7 or a ridge-cut curved shape are used, the shock given to a material to be ground is moderated.

Figure 10:
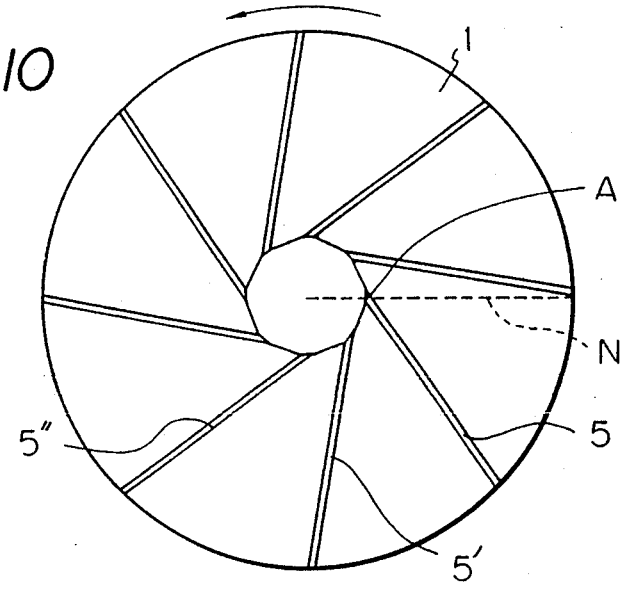
FIGS. 10 through 12 are schematic views illustrating other example of the shape and arrangement of the grinding wheel segments according to the present invention.
Figure 11:
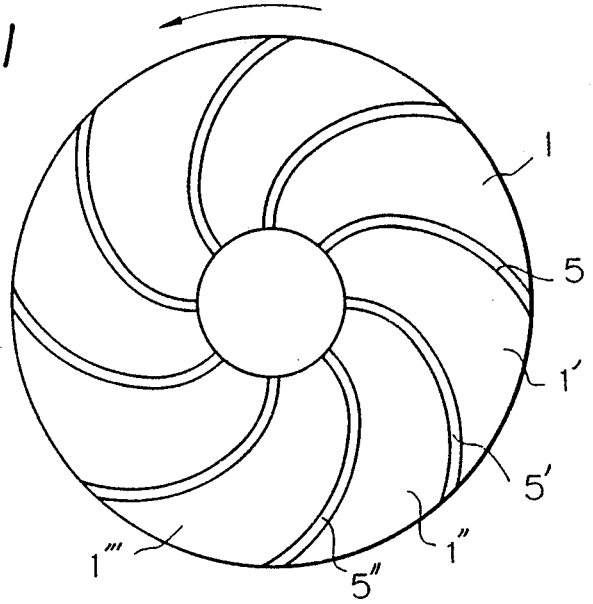
Figure 12:
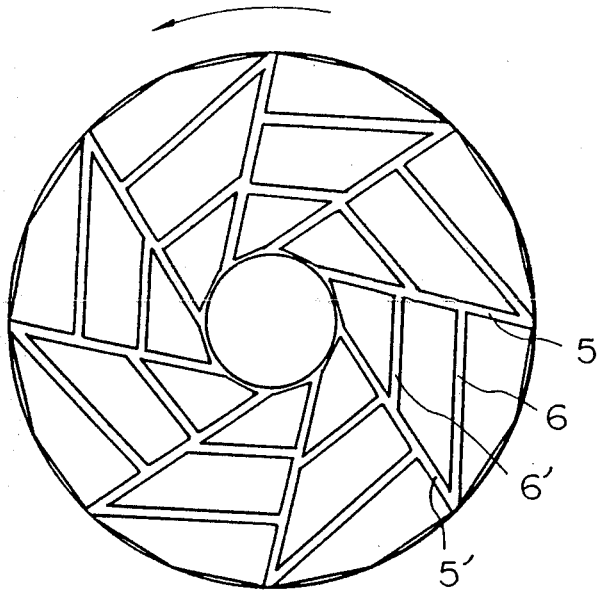

Other examples of the shape and arrangement of the grinding wheel segments are shown in FIGS. 10 through 12. As shown in these drawings, the grinding wheel segments 1 are arranged so that a plurality of grooves 5, 5', 5'',—extend in a radial direction and opposite to the advancing direction (arrow direction) of the platen from the inner side toward the outer side. That is to say, in the arrangement as shown in FIG. 10, the groove 5 is inclined at an angle of 53° with respect to the normal line N extending from the starting point A. Of course, the segments 1 are arranged so that other grooves 6, 6',—are also formed therebetween, as shown in FIG. 12. Grooves having such arrangements are highly effective for removing the waste grinding liquid.

Figure 13:
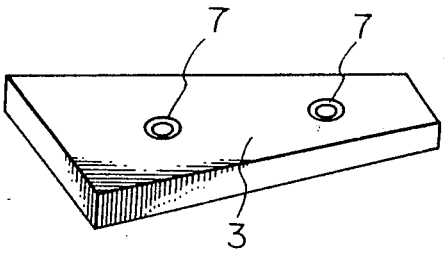
FIG. 13 is a schematic view illustrating an attachment plate having holes for fixing screws.
Figure 14:
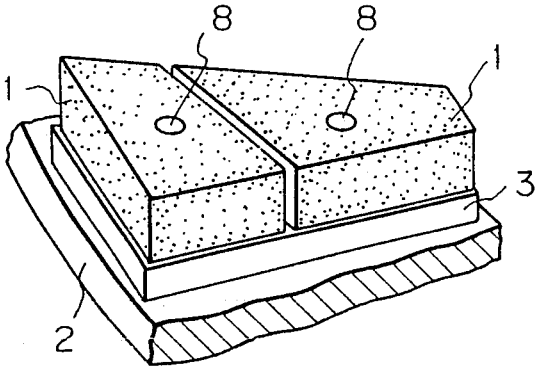
FIGS. 14 and 15 are schematic views illustrating the arrangement of grinding wheel segments bonded to the attachment plate shown in FIG. 13, which is in turn fixed to the pedestal of a lapping platen.
Figure 15:
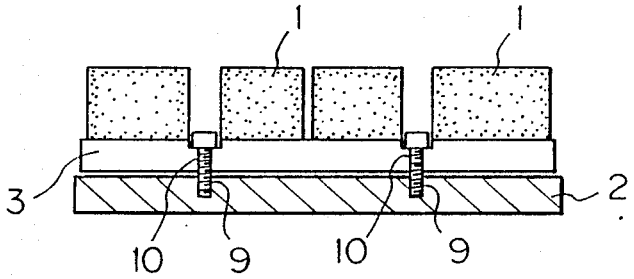
Figure 16:
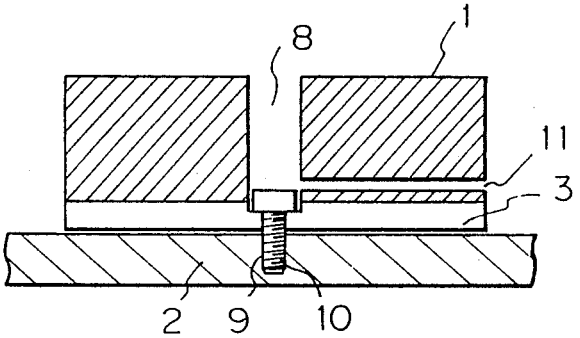
FIG. 16 is a schematic view illustrating a grinding wheel segment having a horizontal hole.

The method of attaching grinding wheel segments to the lapping platen or attachment plate is not particularly critical. An appropriate method may be selected from known methods, for example, an adhesive, bolts and other methods customarily adopted for attachment of articles of this type. For example, the grinding wheel segments 1 may be fixed to the pedestal 2 through attachment plates 3 by fixing screws as shown in FIGS. 13 through 15. In this embodiment, the grinding wheel segments 1 are bonded by adhesive to the attachment plate 3 having holes 7 for fixing screws 10. In turn, the attachment plate 3 is fixed to the pedestal 2 by means of fixing screws 10 inserted into holes 9 provided in the pedestal 2 through the holes 7 and 8 provided, respectively, in the attachment plate 3 and the segments 1.

Furthermore, the grinding wheel segments 1 may have horizontal holes 11 communicated with the holes 8 for fixing screws. The provision of such horizontal holes in the grinding wheel segments enhances the removal of the waste grinding liquid.

The present invention will further be illustrated by way of the following non-limitative example.

EXAMPLE

Figure 5:
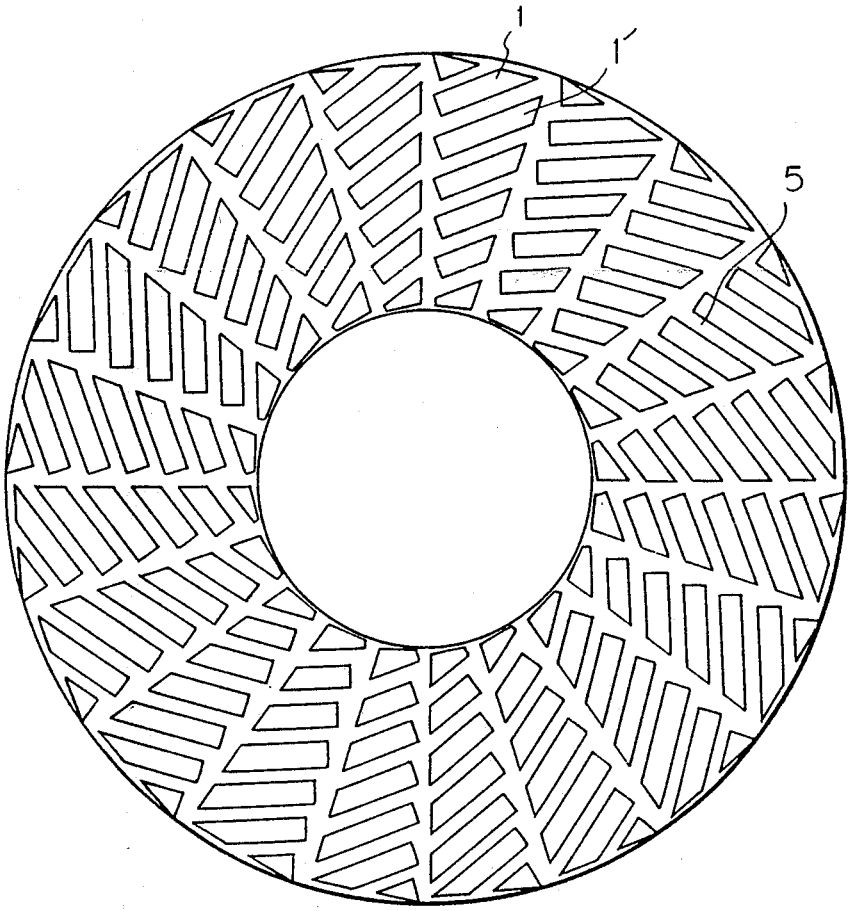
FIG. 5 is an enlarged partial view showing an example of a lapping platen grinding surface according to the present invention.
Figure 6:
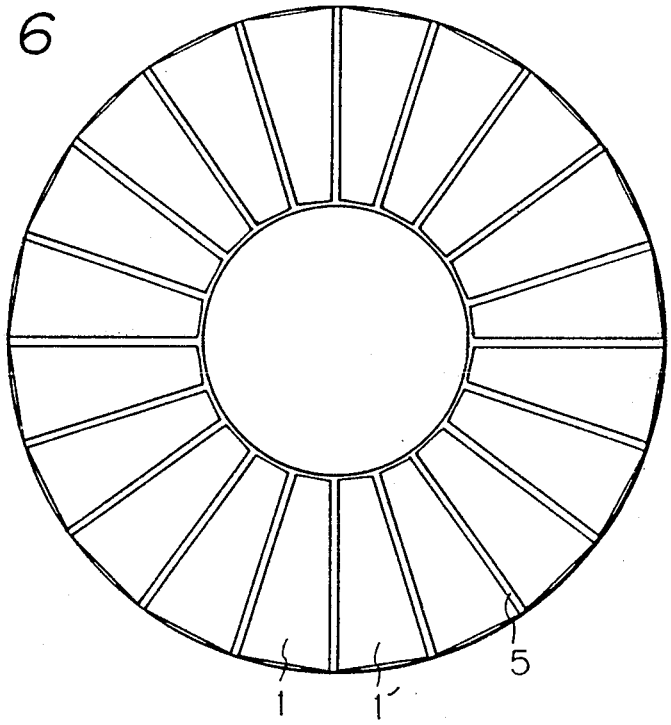
FIG. 6 is an enlarged partial view showing an example of a known lapping platen grinding surface having radial grooves defined by grinding wheel segments.

Abrasive wheel segments of a polyvinyl acetal type water-resistant grindstone having a porosity of 75% and a thickness of 50 mm, which were formed by applying a melamine resin to a porous body of a polyvinyl acetal type synthetic resin containing 10% by volume of finely divided silicon carbide having an average particle size of 10 μm (grain count number of 1500 according to JIS-R-6001), were molded and were arranged on attachment plates as shown in FIG. 3 (lapping platen 1), FIG. 5 (lapping platen 2), and FIG. 6 (comparative platen). Two attachment plates were attached to upper and lower lapping platens of a double-surface lapping machine. A material to be ground was inserted between the upper and lower platens and was ground while rotating the upper platen to the right and the lower platen to the left. Water was steadily supplied during the grinding operation. Doughnut-like discs of aluminum having a diameter of 5¼ inches or 14 inches were ground under the following conditions.

The rotation speed was 80 rpm and the contact pressure was 100 g/cm². For one batch, 16 5¼-inch discs were simultaneously ground and four 14-inch discs were simultaneously ground. The grinding operation was repeated a predetermined number times.

The obtained results are shown in Tables 1 through 6.

In the tables, roughness of the surface is indicated by following parameters.

*Ra;* Arithmetic average roughness.

$$Ra = \frac{1}{L}\int_{O}^{L} |f(x)|\,dx$$

$f(x)$ — Roughness profile

*R*max; Maximum peak-valley roughness.

*R*max = *P*max − *V*min

*P*max — Maximum high to peak in real profile

*V*min — Maximum depth of valley in real profile

*Vcm;* Maximum peak-valley waveness.

*Wcm* = *P*max − *V*min

*P*max — Maximum height of peak in waveness profile

*V*min — Maximum depth of valley in waveness profile

TABLE 1

| Batch No. | | Lapping platen 1 5¼" Aluminum disc 1st | 5th | 10th | 15th | 20th |
|---|---|---|---|---|---|---|
| Stock removal (μm/min) | | 28 | 28 | 25 | 20 | 15 |
| Roughness | Ra (μm) | 0.08 | 0.09 | 0.08 | 0.07 | 0.07 |
| | Rmax (μm) | 0.85 | 0.88 | 0.90 | 1.12 | 1.25 |
| | Wcm (μm) | 3.1 | 3.0 | 3.2 | 3.5 | 3.8 |
| State of ground surface | | good | good | good | good | good |
| State of surface of wheel | | good | good | good | good | slight loading |

TABLE 2

| Batch No. | | Lapping platen 1 14" Aluminum disc 1st | 5th | 10th | 15th | 20th |
|---|---|---|---|---|---|---|
| Stock removal (μm/min) | | 30 | 28 | 22 | 13 | 8 |
| Roughness | Ra (μm) | 0.10 | 0.09 | 0.09 | 0.08 | 0.16 |
| | Rmax (μm) | 0.98 | 0.95 | 1.20 | 1.25 | 2.53 |
| | Wcm (μm) | 3.3 | 3.2 | 3.5 | 3.9 | 4.6 |
| State of ground surface | | good | good | good | grazing | bad |
| State of surface of wheel | | good | good | slight loading | loading | large loading |

TABLE 3

| Batch No. | | Lapping platen 2 5¼" Aluminum disc 1st | 5th | 10th | 15th | 20th |
|---|---|---|---|---|---|---|
| Stock removal (μm/min) | | 37 | 38 | 36 | 32 | 33 |
| Roughness | Ra (μm) | 0.07 | 0.07 | 0.08 | 0.07 | 0.09 |
| | Rmax (μm) | 0.79 | 0.85 | 0.93 | 0.88 | 0.98 |
| | Wcm (μm) | 2.8 | 2.7 | 3.2 | 3.4 | 3.6 |
| State of ground surface | | good | good | good | good | good |
| State of surface of wheel | | good | good | good | good | good |

TABLE 4

| Batch No. | | Lapping platen 2 14" Aluminum disc 1st | 5th | 10th | 15th | 20th |
|---|---|---|---|---|---|---|
| Stock removal (μm/min) | | 33 | 29 | 31 | 27 | 24 |
| Roughness | Ra (μm) | 0.08 | 0.09 | 0.08 | 0.10 | 0.12 |
| | Rmax (μm) | 0.88 | 0.93 | 0.86 | 0.96 | 1.12 |
| | Wcm (μm) | 2.5 | 2.8 | 2.7 | 2.8 | 3.3 |
| State of ground surface | | good | good | good | good | good |
| State of surface of wheel | | good | good | good | good | slight loading |

TABLE 5

| Batch No. | | Comparative lapping platen 5¼" Aluminum disc 1st | 5th | 10th | 15th | 20th |
|---|---|---|---|---|---|---|
| Stock removal (μm/min) | | 26 | 15 | 9 | — | — |
| Roughness | Ra (μm) | 0.08 | 0.15 | 0.18 | — | — |
| | Rmax (μm) | 1.03 | 2.68 | 2.75 | — | — |
| | Wcm (μm) | 3.3 | 4.6 | 4.9 | — | — |
| State of ground surface | | good | grazing | bad | — | — |
| State of surface of wheel | | good | slight loading | loading | — | — |

TABLE 6

| Batch No. | | Comparative lapping platen 14" Aluminum disc 1st | 5th | 10th | 15th | 20th |
|---|---|---|---|---|---|---|
| Stock removal (μm/min) | | 22 | 4 | — | — | — |
| Roughness | Ra (μm) | 0.07 | 0.07 | — | — | — |
| | Rmax (μm) | 0.93 | 1.56 | — | — | — |
| | Wcm (μm) | 2.9 | 5.2 | — | — | — |
| State of ground surface | | good | bad | — | — | — |
| State of surface of wheel | | slight | loading | — | — | — |

TABLE 6-continued

| Batch No. | Comparative lapping platen 14" Aluminum disc | | | | |
|---|---|---|---|---|---|
| | 1st | 5th | 10th | 15th | 20th |
| | loading | | | | |

When $5\frac{1}{4}$-inch aluminum discs were ground by using the lapping platen 1, the lapping platen 2, and the comparative lapping platen, dressing was necessary every 20 batches, every 25 batches, and every three batches, respectively. When 14-inch aluminum discs were ground by using the lapping platen 1, the lapping platen 2, and the comparative platen, dressing was necessary every 10 batches, every 18 batches and every one batch, respectively.

From the data shown in Table 1, it will readily be understood that when grinding was carried out by using the lapping platens 1 and 2 according to the present invention, better results were obtained with respect to each test item than with the comparative lapping platen having radially extending grooves. Moreover, it is seen that the lapping platen 2 gave better results than the lapping platen 1. However, since the grinding surface area of the lapping platen 2 was smaller than that of the lapping platen 1, the total grinding life of the grinding platen was shorter.

We claim:

1. A surface grinding apparatus having a plurality of grinding wheel segments secured in a predetermined arrangement to a rotary driving platen so that the working surfaces of the segments form a single plane wherein planar surfaces of articles to be ground are brought into sliding contact with said segments at said plane, which comprises:

(a) the arrangement of said grinding wheel segments forming a first plurality of surface grooves extending in a generally radial direction and away from the direction of rotation of said grinding wheel segments to the outer periphery of said arrangement of segments;

(b) at least one second surface groove intersecting and in communication with said first plurality of surface grooves and leading to the outer periphery of said arrangement of grinding wheel segments; and (c) predetermined ones of said grinding wheel segments having a horizontal hole therethrough communicating with a vertical hole open to the working surfaces of said grinding wheel segments, said horizontal holes being in communication with the outer periphery of said arrangement of grinding wheel segments to enhance removal of waste grinding fluid from said working surfaces to said outer periphery of said arrangement of grinding wheel segments.

2. A surface grinding apparatus having a plurality of grinding wheel segments secured in a predetermined arrangement to a rotary driving platen so that the working surfaces of the segments form a single plane wherein planar surfaces of articles to be ground are brought into sliding contact with said segments at said plane, which comprises:

(a) the arrangement of said grinding wheel segments forming a first plurality of surface grooves extending in a generally radial direction and away from the direction of rotation of said grinding wheel segments to the outer periphery of said arrangement of segments;

(b) at least one second surface groove intersecting and in communication with said first plurality of surface grooves and leading to the outer periphery of said arrangement of grinding wheel segments; and (c) predetermined ones of said grinding wheel segments including certain ones of the outermost grinding wheel segments having a horizontal hole therethrough communicating with a vertical hole open to the working surfaces of said grinding wheel segments, said horizontal holes of the outermost grinding wheel segments extending to the outer periphery of said arrangement of grinding wheel segments to enhance removal of waste grinding fluid from said working surfaces to said outer periphery of said arrangement of grinding wheel segments.

3. A surface grinding apparatus as set forth in claim 1 or 2, wherein the grinding wheel segments are water-resistant grinding wheel segments formed of a polyvinyl formal type synthetic resin.

4. A surface grinding apparatus as set forth in any one of claims 1 or 2, wherein the grinding wheel segments are arranged so that said first plurality of surface grooves extend away from the direction of rotation of said grinding wheel segments from the inner side toward the outer periphery of said arrangement of grinding wheel segments.

* * * * *